US005225823A

United States Patent [19]

Kanaly

[11] Patent Number: 5,225,823

[45] Date of Patent: Jul. 6, 1993

[54] FIELD SEQUENTIAL LIQUID CRYSTAL DISPLAY WITH MEMORY INTEGRATED WITHIN THE LIQUID CRYSTAL PANEL

[75] Inventor: David B. Kanaly, Melbourne, Fla.

[73] Assignee: Harris Corporation, Melbourne, Fla.

[21] Appl. No.: 621,961

[22] Filed: Dec. 4, 1990

[51] Int. Cl.[5] ..... G09G 3/00

[52] U.S. Cl. ..... 340/793; 340/719; 340/767; 340/784

[58] Field of Search ..... 340/767, 784, 793, 800, 340/762, 782, 750, 780, 811, 718, 719; 350/332, 333; 359/54, 55, 56

[56] References Cited

U.S. PATENT DOCUMENTS

| | | | |
|---|---|---|---|
| 3,940,756 | 2/1976 | Findlay | 340/782 |
| 3,947,840 | 3/1976 | Craford et al. | 340/782 |
| 4,087,792 | 5/1978 | Asars | 340/793 |
| 4,766,430 | 8/1988 | Gillette et al. | 340/793 |
| 4,840,460 | 6/1989 | Bernot et al. | 350/333 |
| 4,870,396 | 9/1989 | Shields | 340/719 |
| 4,908,613 | 3/1990 | Green | 340/719 |
| 5,079,544 | 1/1992 | DeMond et al. | 340/701 |

*Primary Examiner*—Tommy P. Chin
*Assistant Examiner*—Jick Chin
*Attorney, Agent, or Firm*—Evenson, Wands, Edwards, Lenahan & McKeown

[57] ABSTRACT

A field sequential liquid crystal display has a backlight that provides different color fields and a liquid crystal display panel that has a matrix of cells. Data lines are coupled to the cells and provide gray level data to the cells. Select lines are coupled to the cells and enable the cells. The cells include integrated memories coupled to the data lines, these integrated memories storing gray level data received via the data lines. The integration of the memories on the display panel allows all of the cells on the panel to be charged approximately simultaneously so that the time any one color is backlighting the entire display approaches an optimum fraction of a frame.

2 Claims, 4 Drawing Sheets

FIELD SEQUENTIAL LIQUID CRYSTAL DISPLAY WITH MEMORY INTEGRATED WITHIN THE LIQUID CRYSTAL PANEL

FIELD OF THE INVENTION

The present invention relates to field sequential liquid crystal displays, and more specifically, to field sequential liquid crystal displays with memory integrated within the liquid crystal panel.

BACKGROUND OF THE INVENTION

A conventional monochrome liquid crystal display (LCD) capable of displaying video images uses a matrix of pixels. A pixel is defined as the smallest discernible picture element. An image is created on the LCD by varying the gray level of each pixel in the matrix. The gray level of all pixels is updated, typically, every 1/60 of a second, or 16.7 ms, which is referred to as a "frame".

A conventional, sunlight readable, color LCD has each pixel subdivided into at least three primary color subpixels-red, green and blue. These subpixels are too small to be perceived separately. Instead, the human eye integrates the pixel area and perceives only the composite pixel. Sunlight readable color is achieved by using a powerful white backlight and locating red, green or blue filters over each subpixel. Varying the gray level of each subpixel in a pixel determines the mix of red, green and blue in a pixel and consequently, its color and brightness. As in a monochrome display, video images are displayed by updating gray levels every frame, i.e. every 16.7 ms. These conventional displays use nematic liquid crystal, including twisted nematic, supertwist and other variants. Gray level control is achieved for these conventional LCD's by controlling the transmissivity of each liquid crystal pixel cell. Using nematics, transmissivity is monotonically related to the electrical charge deposited on each cell, and incremental control of gray level is easily achieved.

A different type of LCD, known as a field sequential LCD (FSLCD), minimizes the power required to produce sunlight readable color LCD's. For the FSLCD, each 16.7 ms frame is further divided into three equal time intervals, or "fields" of 5.55 ms each. During each field, a high efficiency colored light source is used to backlight the liquid crystal display panel, first with red, then with green, and then with blue light.

A field sequential LCD is more efficient than other conventional LCD's because no color filters are used and each color component of the backlight is allowed to pass through the entire pixel area, and not just a subpixel fraction of each pixel. The human eye cannot respond to these fast changes, and so integrates the light within each 16.7 ms. What is perceived is a pixel having the desired composite color and brightness.

Access to each cell in the matrix is enabled by a vertical column, with a pulse of such amplitude to produce a desired gray level being applied via a horizontal row. This pulse is used to charge the cell. (Note that the terms "row" and "column" are interchangeable throughout this disclosure without change in meaning.)

The charging of cells is performed one column at a time, from left to right on the matrix. The gray levels are set first, followed by the backlighting of the cells that have their gray levels set, using a specific colored lamp, then extinguishing of that specific colored lamp, followed by resetting of gray levels for the next specific colored lamp. This process moves as a wave from left to right across the matrix display. Typically, with a three color Red, Green, Blue, backlighting system, the light sources or lamps of one color are interposed with the others as follows: Red, Green, Blue, Red, Green, Blue, Red, etc., resulting in a fairly complex backlighting system.

At any instant, the width of the back of the liquid crystal display panel which the backlight is allowed to illuminate is restricted, so as not to backlight the cells that are set for the preceding color, and/or cells set for a following color. As a consequence of this limitation on active backlight width, the time which an energized backlight is present for any one column is brief, and peak light output required of the backlight is high.

There is a need for a field sequential liquid crystal display in which all of the cells (pixels) in the display are charged approximately simultaneously, so that the backlight of the display is no longer restricted at any one time to a limited number of columns, thereby allowing backlighting of the entire display for any one color to be accomplished by a single lamp which can be energized at a lower intensity for as long as approximately one third of the frame.

SUMMARY OF THE INVENTION

This and other needs are met by the present invention which provides a field sequential liquid crystal display having a backlight that provides different color fields and a liquid crystal display panel that has a matrix of cells. Data lines are coupled to the cells and provide gray level data to the cells. Select lines are coupled to the cells and enable the cells. The cells include integrated memories, located at each cell, coupled to the data lines, these integrated memories storing gray level data received via the data lines. These integrated memories have become practical to fabricate since transistor devices used in active matrix liquid crystal display technology are continuing to reduce in size, as the transistor technology is changed from Amorphous Silicon, to Polycrystaline Silicon, to single crystal silicon using zone melt recrystalization and other similar processes. In single crystal silicon, the memory and associated circuits described herein can be made to occupy less than 10% of the area allocated to each pixel, permitting redundant circuits to be employed. Various integrated circuit repair techniques can also be employed to improve manufacturing yield, including interconnection of good circuits by separate metalization layers, disconnection of faulty circuits by laser, and other techniques that permit replacement of faulty circuits with good circuits.

The integration of the memories on the display panel allows all of the cells on the panel to be charged approximately simultaneously so that the time any one color is backlighting the entire display approaches an optimum fraction of a frame.

The present invention provides many advantages over conventional field sequential liquid crystal displays. For example, with the present invention, all of the pixels in the display are charged approximately simultaneously. This allows the backlight of the display to no longer be restricted at any one time to a limited number of columns. For the same reason, the time any one column is backlit is longer. Consequently, the time any one color is backlighting the entire display approaches approximately one-third of a frame, thereby reducing the peak luminance required of the backlight to achieve the same time average luminance, and extending lamp life. Also, the backlight used can be much simpler than that needed in a conventional field sequential display, since light is no longer required to sweep from one side of the display to the other, as a moving wave.

An embodiment of the present invention also provides a color sequential active matrix liquid crystal display, using a ferroelectric liquid crystal material, that exhibits a very large number of colors. Ferroelectric liquid crystals lack good incremental control of transmissivity, however they respond well to simple bistate control: full on, or full off. They are attractive because they have a wide viewing angle and high contrast. The ferroelectric color sequential active matrix liquid crystal display with memory integral with each cell according to the present invention not only has the advantages of simpler backlighting and avoidance of high peak backlight illuminance common to the nematic color sequential active matrix liquid crystal display with memory integral to each cell, but also has a wide range of colors with wide viewing angle and high contrast. This is particularly advantageous for military and other wide ambient temperature applications where the close temperature control required of ferroelectric liquid crystal displays is not a disadvantage since temperature control is normally required, and wide viewing angle and/or high contrast are very important. The ferroelectric color sequential active matrix liquid crystal display with memory integral to each cell also has the advantage of being an all digital display system, i.e. there are no analog voltage levels required from the symbol generator/graphics processor to the liquid crystal cells.

Other objects, advantages and novel features of the present invention will become apparent from the following detailed description of the invention when considered in conjunction with the accompanying drawings.

DETAILED DESCRIPTION OF THE DRAWINGS

Figure 1:
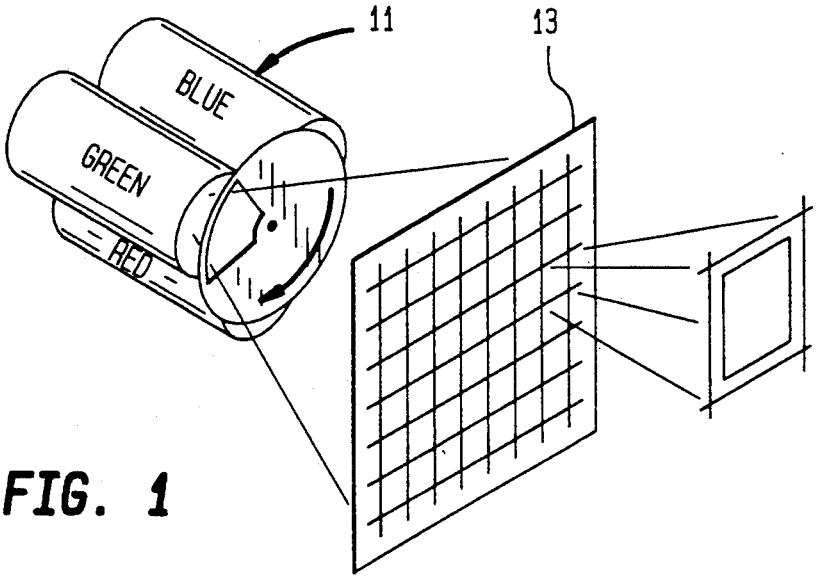
FIG. 1 illustrates a field sequential liquid crystal display.

FIG. 1 illustrates, in simplified form, a field sequential active matrix liquid crystal display. There is a light source 11 that provides three different colored lights in sequence, these colored lights passing through a liquid crystal display panel 13. The panel 13 is a matrix of pixels (or cells) whose transmissivity (or gray level) is controllable.

Figure 2:
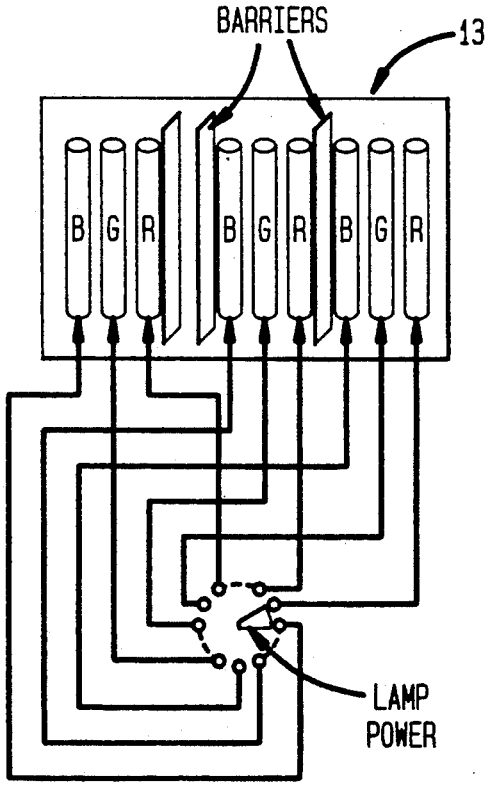
FIG. 2 illustrates in more detail a conventional arrangement to provide sequential timing of backlights and also shows barriers that are normally needed to restrict the width of the back of a liquid crystal display panel which the backlight is allowed to illuminate.

FIG. 2 illustrates in more detail an arrangement to provide the sequential timing of backlights and also shows barriers, some form of which are normally needed to restrict the width of the back of the liquid crystal display panel which the backlight is allowed to illuminate. These means prevent the backlighting of the cells that are set for the preceding color, and/or cells set for a following color. As a consequence of this limitation on active backlight width, the time which an energized backlight is present for any one column is brief, and peak light output required of the backlight is high.

Figure 3:
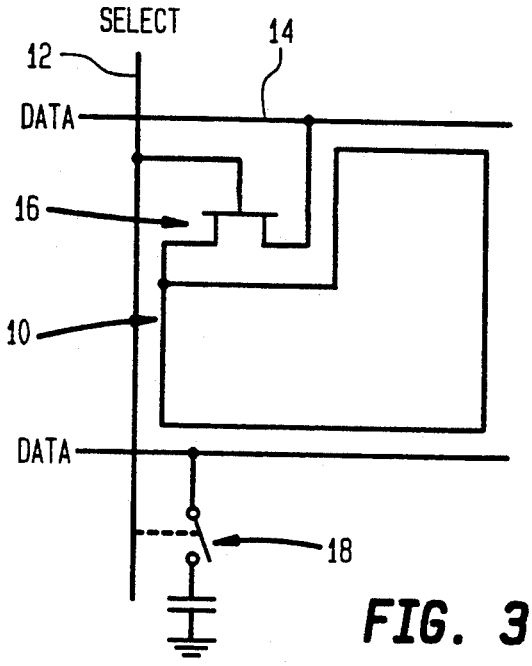
FIG. 3 shows two illustrations of the same cell of a conventional liquid crystal display, where one illustration is shown closer to physical form, while the other illustration is shown more schematically.

FIG. 3 shows a conventional cell 10 that is typically used in the panel 13 of FIG. 1. Access to each cell 10 in the panel 13 is enabled by a vertical column (SELECT line) 12 via a thin film field effect transistor 16. When enabled via the SELECT line 12, a pulse of such amplitude to produce the desired gray level (i.e. data) can be applied to the cell 10 via a horizontal row (DATA line) 14. The pulse on the DATA line 14 is used to charge the cell 10.

Each cell 10 can be also represented schematically, as seen in FIG. 3, with a cell circuit 18 illustrated schematically as a switch that routes the gray level charge pulse from the DATA line 14 to a capacitor. (The cell 10 electrically acts as a capacitor.)

Figure 4:
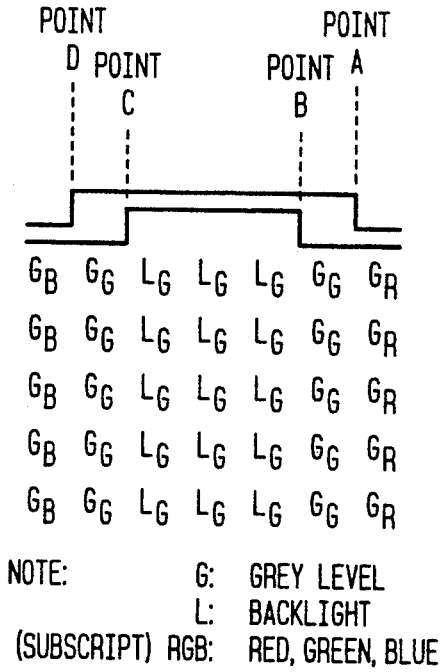
FIG. 4 (PRIOR ART)
FIG. 4 shows the timing sequence for a conventional liquid crystal display constructed of the cells of FIG. 3.

FIG. 4 depicts the timing for a liquid crystal display comprising cells 10, 18 such as that shown in FIG. 3. The charging of cells 10, 18 is performed one column at a time, for example, from left to right. As can be seen in FIG. 4, the process moves as a wave, with the gray levels for a column being set first (Point A in FIG. 4). This is followed by the backlighting of a first color (Point B), then the extinguishing of the first color (Point C), and the resetting of the gray levels for the next color in the sequence (Point D). At any instant, the width of the back of a liquid crystal panel 13 that is made up of conventional cells 10, 18 which the backlight 11 is allowed to illuminate is restricted. This prevents the backlighting of cells that are set for a preceding or a following color. As a consequence, the time which an energized backlight is present for any one column is brief, and the peak light output required of the backlight is high.

Figure 5:
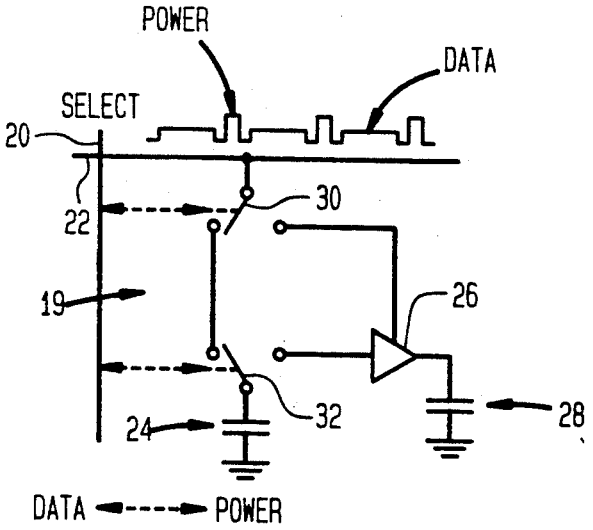
FIG. 5 schematically shows a cell for a liquid crystal display having an integrated field memory constructed in accordance with an embodiment of the present invention.

A cell 19 which can be used in a liquid crystal panel 13 shown in FIG. 1 and which overcomes the limitations of a panel composed of the conventional cells shown in FIG. 3 is illustrated schematically in FIG. 5. The cell 19 does not consist of a single switch and the cell capacitance, as in the cell of FIG. 3. Instead, the cell 19 includes means for implementing an integrated field memory.

As seen in FIG. 5, the cell 19 has a small data storage capacitor 24, an amplifier 26, a main cell capacitance 28 and switches 30, 32. The data storage capacitor 24 is, for example, a small opaque section of the cell 19 that is partitioned from the main cell 19. Alternatively, the data storage capacitor 24 is a separately deposited capacitive element. Switch 30 is coupled to a DATA line 22, while the SELECT line 20 controls the position of the switches 30, 32.

The amplifier 26 is used to produce a more powerful charge in the main cell capacitance 28 when supplied with a small charge from the data storage capacitor 24. This amplifier 26 need not be a linear amplifier. In fact, any means of producing a charge in the main cell capacitance 28 that is proportional to the charge in the data storage capacitor 24 can be used. For example, a simple time controlled switching scheme can be used.

Each field of the three-field frame of the display 13 is subdivided into a long data phase and a brief power phase. During these times, the rows, such as DATA line 22, are used to alternately transmit data or power. The columns, such as select line 20, are used to configure the switches 30, 32 in all of the cells 19 of the display 13 for data or power, using each individual cell's switches 30, 32. Switches to change the state of the rows or columns can be either located on the display 13 or external to the display 13.

In operation, the rows (DATA line 22) are first placed in the data mode. Through the column controlled switches 30, 32, each cell 19 in one column is placed in the data mode. The gray level data, in the form of analog pulses, is routed to each data storage capacitor 24, one column at a time. This is represented in the timing diagram of FIG. 6 by line 40, with the reference $D_G$ representing the gray level data time for the green field.

Figure 6:
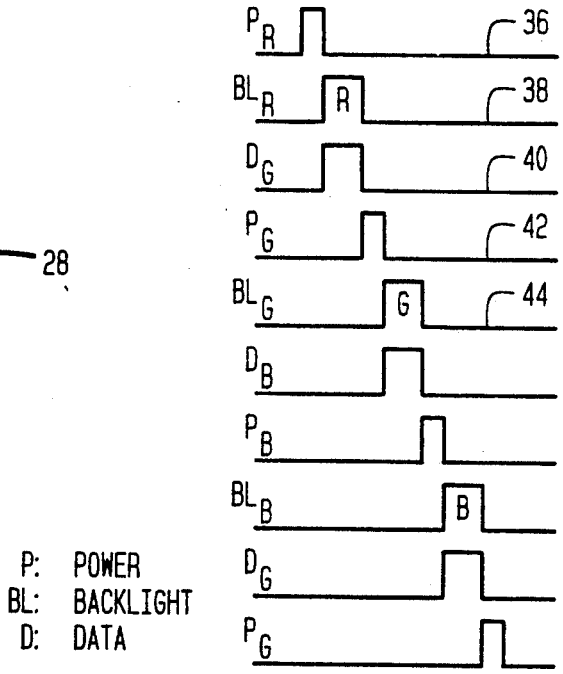
FIG. 6 shows the timing sequence for a liquid crystal display constructed according to the present invention of the cells of FIG. 5.

When each of the cells 19 in the entire display 13 has received and stored the gray level data, all of the cells 19 are switched to the power mode. This is shown in FIG. 6 by line 42. At each cell 19, as the amplifier 26 for the cell 19 is connected to receive power, the data storage capacitor 24 is switched to be free of the row (DATA line 22) and connected to the input of the amplifier 26. Consequently, the main cell capacitance is charged to a level that is proportional to the original gray level command.

The cells 19 in any column are charged simultaneously, however, the charging of columns of cells is slightly skewed to prevent a simultaneous peak load from lowering the power bus voltage on each row. The rows then switch back to the data mode. Before the data loading operation begins, all rows are very briefly grounded, removing the previous gray level command. Data loading then commences, column by column. This is illustrated in FIG. 6, which depicts one frame (1/60 sec) of field sequential operation of the display 13.

A red power phase ($P_R$) is referenced by numeral 36. In the red power phase ($P_R$), all of the cells 19 of the display 13 are charged from the previously stored gray level data to the commanded red gray level. The red backlight $BL_R$ is then turned on, as indicated by reference numeral 38. Simultaneously, (reference numeral 40), the green gray level data $D_G$ is loaded in the entire display 13 column by column. The green power phase $P_G$ then occurs (reference numeral 42), followed by the green backlight $BL_G$, etc.

The embodiment of the invention illustrated in FIG. 5 provides advantages over conventional field sequential displays. For example, with the present invention, all of the pixels in the display are charged approximately simultaneously. This allows the backlight of the display to no longer be restricted at any one time to a limited number of columns. For the same reason, the time any one column is backlit is longer. Consequently, the time any one color is backlighting the entire display approaches approximately one-third of a frame, thereby reducing the peak luminance required of the backlight to achieve the same time average luminance, and extending lamp life. Also, the backlight used can be much simpler than that needed in a conventional field sequential display, since light is no longer required to sweep from one side of the display to the other, as a moving wave.

Figure 7:
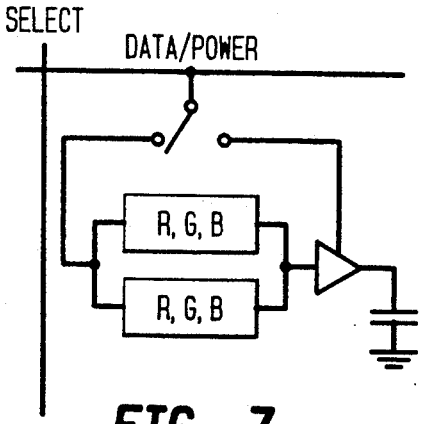
FIG. 7 shows schematically a single cell of a liquid crystal display constructed in accordance with an embodiment of the present invention in which the display has an integral frame memory.

Another embodiment of the present invention is illustrated in FIG. 7. In this embodiment, the display has a memory not just for one field of a three field frame, but rather incorporates a memory for an entire frame of data as part of the liquid crystal display panel.

In a conventional liquid crystal display, normal video data is transmitted to a display one pixel at a time, with each color's gray level (red, green, blue) grouped together serially or in parallel. However, for field sequential operation, all the data for one color, assume red, must be grouped together to be used first, then all green data second, and blue, third. A memory external to the liquid crystal display panel is normally used to do this.

In the embodiment of FIG. 7, this memory that is normally external to the display is integrated into the display. In operation, the display is similar to that of FIG. 5. Six data storage capacitors are used, instead of just one, in an analog ping-pong memory with a separate data storage capacitor being assigned to each of the red, green and blue fields in each half.

Figure 8:
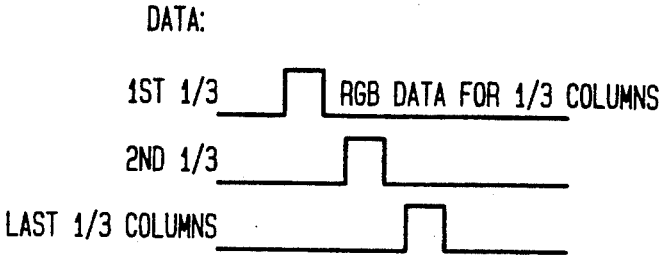
FIG. 8 shows the timing sequence for a liquid crystal display constructed according to the present invention of the cells of FIG. 7.

While the display is presenting one frame (red, green and blue), the panel 13 is simultaneously loading the red, green and blue data into memory for the next frame. As seen in FIG. 8, the data for one-third of the column is loaded into memory during the first one-third of the frame, etc. The data is received into memory in exactly the sequence that it is readily available, column by column, with the data for all pixels in a column grouped (red, green, blue) for each pixel. However, the data is used as required for field sequential use, all red first, all green next, all blue last, so the desired regrouping of data is achieved, and an external memory is no longer required.

Figure 9:
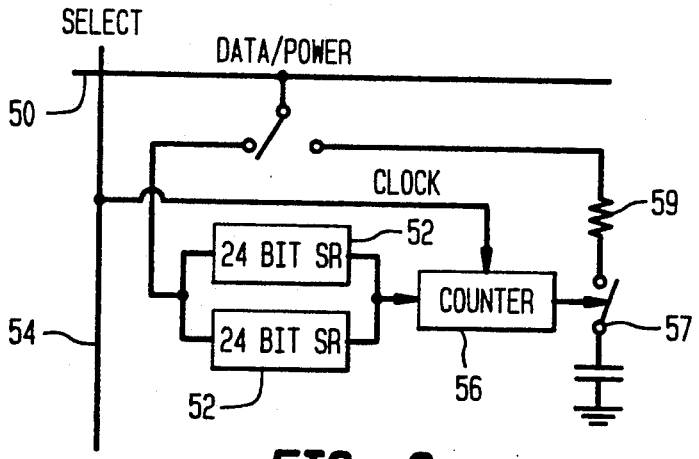
FIG. 9 illustrates another embodiment of the present invention.
Figure 10:
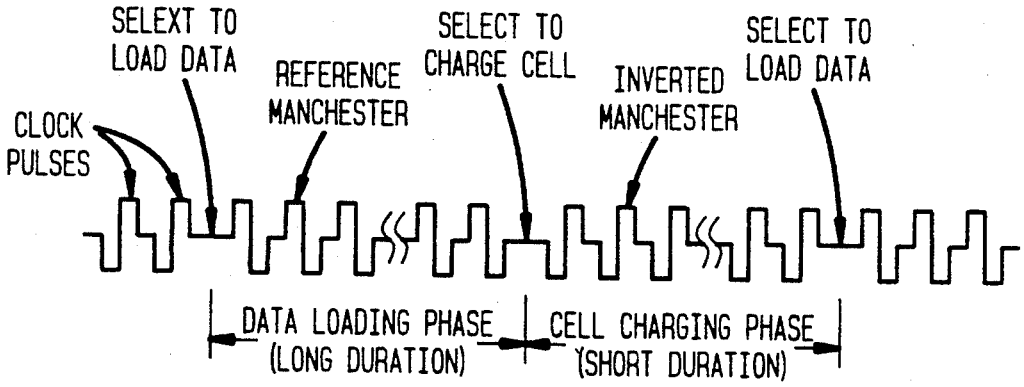
FIG. 10 is a waveform diagram for the data loading and cell charging of cells constructed in accordance with the embodiment of the invention illustrated in FIG. 9.

Another embodiment of the present invention is illustrated in FIG. 9. This embodiment implements the embodiment of FIG. 7 in a digital form. Serial digital data is routed via the rows 50 into shift registers 52 located at each cell. Each twenty-four bit shift register 52 holds eight bits of gray level command for each color. To facilitate the transfer of this digital data, and for another purpose discussed below, a clock signal is continuously distributed to a counter 56 provided in all cells, using the column conductors 54 to serve both the clock function and the column select function. One of several ways to implement this is illustrated in FIG. 10, wherein the clock pulse waveform is inverted to distinguish the two cell mode phases of cell operation: the data loading or data phase, and the cell charging or power phase. It must be recalled that data loading occurs at some time during the relatively long duration backlight exposure times, whereas pixel cell charging occurs only briefly between backlight exposure times, as was illustrated in FIG. 6.

As illustrated in FIG. 9, the two shift registers 52 are arranged in a "ping-pong" configuration, as before, so that data can be loaded in as 24 contiguous bits in one shift register 52, whereas only 8 bit words are removed from the other shift register 52 for each cell charging operation. The conversion of each 8 bit digital gray level command into an analog charge is shown in FIG. 9 using the counter 56 and a resistance 59. Upon commencing the cell charging, or power, phase, the next 8 bit word is loaded into the counter 56 and the switch 57 is closed, causing the cell charging to begin. The counter 56 is then decremented to zero and the switch 57 is opened, resulting in an analog charge in proportion to the digital gray level command.

Figure 11:
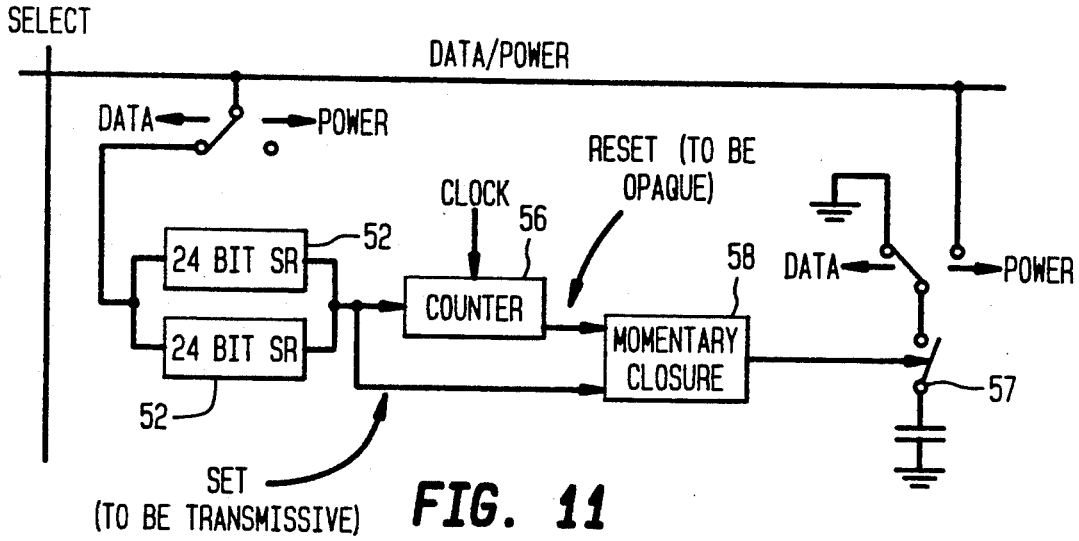
FIG. 11 illustrates another embodiment of the present invention.

Another embodiment of a color sequential active matrix liquid crystal display, uses a ferroelectric liquid crystal material to exhibit a very large number of colors, and is illustrated in FIG. 11. Ferroelectric liquid crystals lack good incremental control of transmissivity, however they respond well to simple bistate control: full on, or full off. The ferroelectric liquid crystals are attractive because they have a wide viewing angle and high contrast. In a 3 field frame, by using an integral memory within each cell, 8 bits or more of gray level (256 or more levels) can be stored digitally at each pixel during one field for use during the next field. With ferroelectric liquid crystal, gray level control is achieved (using the 8 bit words) by controlling the time each pixel is fully transmissive, as opposed to controlling the amount of transmissivity of each pixel. At the beginning of the field all pixels except those intended to be full opaque are commanded to the maximum transmissive state.

As illustrated in the embodiment of FIG. 11, using a distributed clock signal, the stored command at each pixel is counted down to zero, at which time each pixel is commanded to the maximum opacity state. With ferroelectric liquid crystal, it is not necessary to hold the charge on each cell since ferroelectric liquid crystal will stay in the last commanded state. Consequently, a circuit 58 is used to implement a momentary switch closure function. During the power phase this circuit 58 is momentarily closed to the power/data bus, and during the data phase, when the counter 56 decrements to zero, the circuit 58 is momentarily closed to ground. Ground can be made to be present by routing another ground bus to every pixel, or by other means. Using a 50 MHz clock, more than 256 time durations are available in each 5.56 ms field, for every pixel in the display, and therefore the display can provide, simultaneously, a wide range of colors, a wide range of illuminance intensity of those colors, and smooth anti-aliasing of any graphic generated objects in those colors.

The ferroelectric color sequential active matrix liquid cell crystal display with memory integral with each cell not only has the advantages of simpler backlighting and avoidance of high peak backlight illuminance common to the nematic color sequential active matrix liquid crystal display with memory integral to each cell, but also a wide range of colors with wide viewing angle and high contrast. This is particularly advantageous for military and other wide ambient temperature applications where the close temperature control required of ferroelectric liquid crystal displays is not a disadvantage since temperature control is normally required, and wide viewing angle and/or high contrast are very important. The ferroelectric color sequential active matrix liquid crystal display with memory integral to each cell also has the advantage of being an all digital display system, i.e. there are no analog voltage levels required from the symbol generator/graphics processor to the liquid crystal cells.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A liquid crystal display panel made of ferroelectric liquid crystal, comprising:

a matrix of cells;

data lines coupled to the cells and which provide gray level data to the cells;

select lines coupled to the cells and which enable the cells;

wherein each cell includes a plurality of shift registers coupled to the data lines, with each shift register storing gray level data received via said data lines for a plurality of fields within a frame;

wherein each cell includes a main cell capacitance and means for controlling a duration of time that the main cell capacitance is transmissive, said duration of time being proportional to said gray level data stored in one of said shift registers, wherein the means for controlling a duration of time includes: a switch coupled to the main cell capacitance that in a first position causes said main cell capacitance to be transmissive and in a second position causes said main cell capacitance to be maximally opaque, a momentary switch closure circuit coupled between the plurality of shift registers and the switch, said momentary switch closure circuit controlling the switch; and a counter coupled to the momentary switch closure circuit and controlling said momentary switch closure circuit.

2. The panel of claim 1, wherein each cell has two said shift registers, each said shift register being a twenty-four bit shift register, each said frame having three fields, and further comprising means for switching the two shift registers such that one shift register is storing gray level data for one frame while the other shift register is providing gray level data to the main cell capacitance for a previous frame.

* * * * *